US007278271B2

(12) United States Patent
Chou et al.

(10) Patent No.: US 7,278,271 B2
(45) Date of Patent: Oct. 9, 2007

(54) RADIAL HIGH ENERGY ACOUSTIC DEVICE AND THE APPLIED THERMOACOUTIC DEVICE

(75) Inventors: Ya-Wen Chou, Chu-Tung (TW); Ming Shan Jeng, Chu-Tung (TW)

(73) Assignee: Industrial Technology Research Institute, Hsinchu (TW)

( * ) Notice: Subject to any disclaimer, the term of this patent is extended or adjusted under 35 U.S.C. 154(b) by 380 days.

(21) Appl. No.: 11/023,490

(22) Filed: Dec. 29, 2004

(65) Prior Publication Data

US 2006/0137362 A1 Jun. 29, 2006

(30) Foreign Application Priority Data

Dec. 27, 2004 (TW) ..... 93140756 A

(51) Int. Cl.
*F25B 9/00* (2006.01)
*H01L 41/00* (2006.01)
*H02N 2/00* (2006.01)

(52) U.S. Cl. ..... 62/6; 310/322

(58) Field of Classification Search ..... 62/6; 310/322

See application file for complete search history.

(56) References Cited

U.S. PATENT DOCUMENTS 4,686,407 A * 8/1987 Ceperley ..... 310/323.01
5,115,157 A * 5/1992 Blumenau ..... 310/11
5,456,082 A * 10/1995 Keolian et al. ..... 62/6
5,647,216 A * 7/1997 Garrett ..... 62/6
6,637,211 B1 * 10/2003 Swift et al. ..... 62/6
6,804,967 B2 * 10/2004 Symko et al. ..... 62/6
2003/0192322 A1 * 10/2003 Garrett ..... 62/6
2005/0109042 A1 * 5/2005 Symko et al. ..... 62/6
2006/0119224 A1 * 6/2006 Keolian et al. ..... 310/339

OTHER PUBLICATIONS

Chen, et al. "Development of Miniature Thermoacoustic Refrigerators" 40th AIAA Aerospace Sciences Meeting and Exhibit, Jan. 14-17, 2002/Reno, NV pp. 1-10.

* cited by examiner

*Primary Examiner*—William C Doerrler
(74) *Attorney, Agent, or Firm*—Birch, Stewart, Kolasch & Birch, LLP

(57) ABSTRACT

A radial acoustic driver uses to generate higher amplitude of pressure fluctuation with radial type standing wave. The radial acoustic driver includes a cyclic type resonance tube which is filled with a working fluid inside, and a ring type electricity-acoustic energy transducer that is inside the cyclic type resonance tube for generating a radial acoustic wave when receiving electricity.

14 Claims, 3 Drawing Sheets

RADIAL HIGH ENERGY ACOUSTIC DEVICE AND THE APPLIED THERMOACOUTIC DEVICE

BACKGROUND OF THE INVENTION

1. Field of the Invention

The invention relates to an acoustic driver and applied thermoacoustic device, and particularly to a radial acoustic driver and applied thermoacoustic device.

2. Related Art

Micro thermoacoustic technology uses acoustic waves to promote active heat transfer to create a cooler environment and effectively transfer heat from a heat source to a larger and cooler space. Together with passive heat transfer equipment such as a heat sink or fan, the heat is more easily removed using this technology. The technology is not only useful for removing heat from electronic devices but also for precise temperature control.

The composition of a micro thermoacoustic device includes an acoustic driver, a resonance tube, a stack and two heat exchangers. The fundamental aspect of the micro thermoacoustic device is that the acoustic driver generates pressure fluctuation of standing wave in the resonance tube to work on the fluid therein. A working fluid in resonator tube is ideally compressed and expanded adiabatic. Those processes cause heat to be transferred from one end of stack to the other. Thus, the temperature gradient is formed along the stack, producing a cooling effect.

Generally, conventional thermoacoustic devices generate pressure fluctuation by the acoustic driver. There are two kinds of thermoacoustic devices: as shown in FIG. 1, one includes a cylinder type resonance tube1, a planer acoustic driver3 used to produce axial acoustic waves, a stack 5, and heat exchangers 7 and 9 located at the opposite sides of the stack 5; as shown in FIG. 2, the disc type thermoacoustic device includes a planer acoustic driver 2, which generates radial acoustic waves by the design of slabs 4. The ring type stack of the disc type thermoacoustic device can be assembled around the cylinder tube such that the cooling capacity is higher even if the stack has the same thickness. The greatest amplitude of the pressure wave occurs around the locations of acoustic driver and the anti-node of the wave. However, whether the cylinder type thermoacoustic device or the disc type thermoacoustic device is used, the properties of acoustic driver dominated the amplitude of pressure fluctuation.

Concerning the cooling capacity of the thermoacoustic device, cooling capacity and the amplitude is directly proportional to acoustic energy, increasing the input acoustic energy into the thermoacoustic device is the only way to increase the cooling capacity. However, the acoustic energy generated by the planer type acoustic driver is restricted by the property of the piezoelectricity material.

There are many researches make an effort on increasing the cooling capacity of thermoacoustic device. However, improvement is not clear in the field of micro drivers. Therefore there remains the problem of how to increase pressure fluctuation without increasing the consumption of energy.

SUMMARY OF THE INVENTION

The object of the invention is to provide a radial acoustic wave along a cyclic resonator through a ring type acoustic driver. A pressure fluctuation is much higher than conventional planar acoustic driver is generated by the invention.

Therefore when the invention is applied to a thermoacoustic device, the cooling capacity can be enhanced to solve the aforesaid problem of prior arts.

A radial acoustic driver according to the invention includes a cyclic type resonance tube which is filled a working fluid inside, and a ring type electricity-acoustic energy transducer. The transducer cyclic type resonance tube generates radial acoustic waves along resonator as receiving electricity. Pluralities of cyclic stacks are mounted in the cyclic type resonance tube and each of the stacks is composed of a plurality of plates. There is at least one supporting element between the plates to support the structure for creating a passage for the working fluid. Furthermore, pluralities of heat exchangers are mounted adjacent to the opposite ends of each stack to transfer heat to the outside.

The ring type electricity-acoustic energy transducer is composed of an electricity-acoustic energy transducing material, such as piezoelectricity material. The center of the stack can be located between the node and the anti-node of the radial acoustic wave. The heat exchangers can be mounted at opposite sides of the stack.

According the technical features described above, it is understood that the invention is able to provide a radial acoustic wave. According to the principle of inverse proportion of pressure fluctuation to the measure of area, with the invention a concentration effect occurs at the center of the disc. Therefore a higher pressure fluctuation can be generated without increasing the input energy, making the applied thermoacoustic device more efficient in cooling.

BRIEF DESCRIPTION OF THE DRAWINGS

The invention will become more fully understood from the detailed description given herein below. However, this description is for purposes of illustration only, and thus is not limitative of the invention, wherein.

DETAILED DESCRIPTION OF THE INVENTION

The radial acoustic driver uses a ring type assembly that is made of an electricity-acoustic energy transducing material, such as a piezoelectricity material. After driven by an input power with designed frequency, the ring type assembly combining normal vibration and a bending effect can produce higher amplitude of pressure fluctuation with radial acoustic wave's type along the resonator. According to the principle of inverse proportion of pressure fluctuation to the measure of area, with the invention a concentration effect occurs at the center of the disc. Therefore the amplitude of pressure fluctuation is enhanced at the center, the problem of low acoustic pressure in the prior art can be solved. Furthermore, higher pressure fluctuation can be obtained without increasing the input energy, making the applied thermoacoustic device more efficient in cooling, and creating wider applications for the micro thermoacoustic device.

Figure 1:
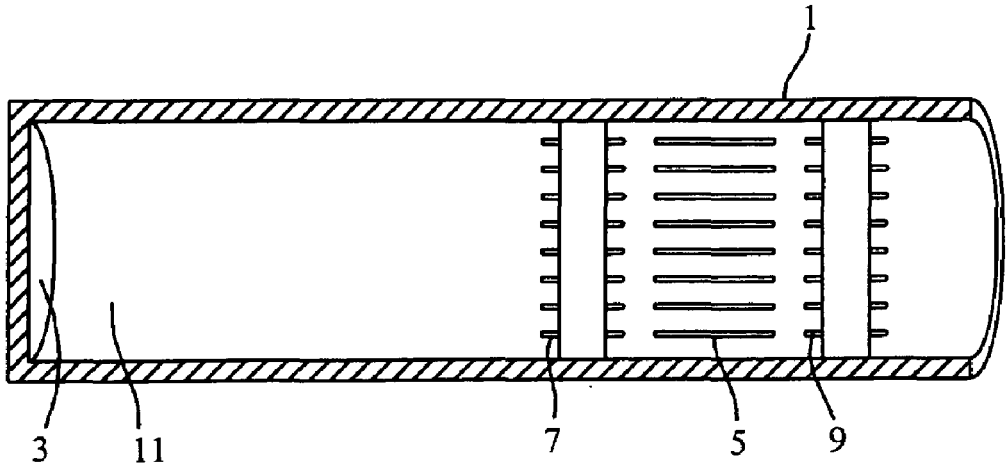
FIG.1 (PRIOR ART)
FIG. 1 is an explanatory view of a conventional thermoacoustic device and planer acoustic driver using the same.
Figure 2:
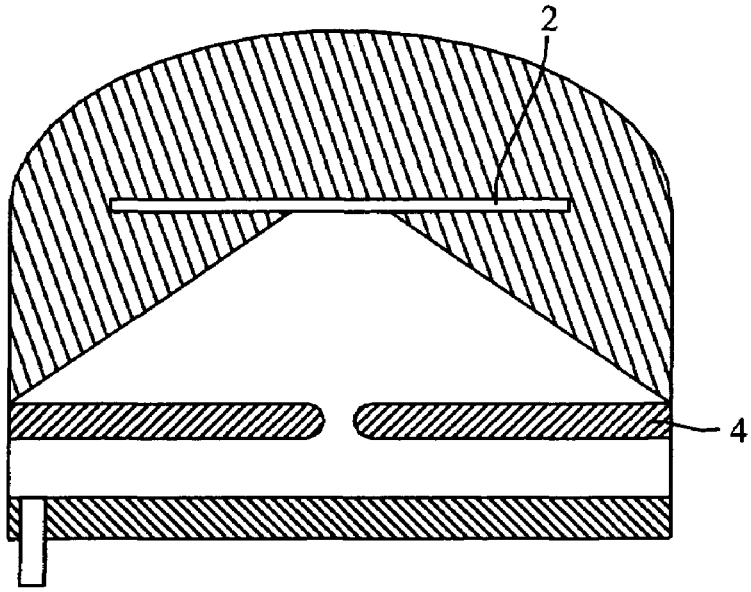
FIG.2 (PRIOR ART)
FIG. 2 is an explanatory view of a conventional disc type thermoacoustic device and planer acoustic driver using the same.
Figure 3:
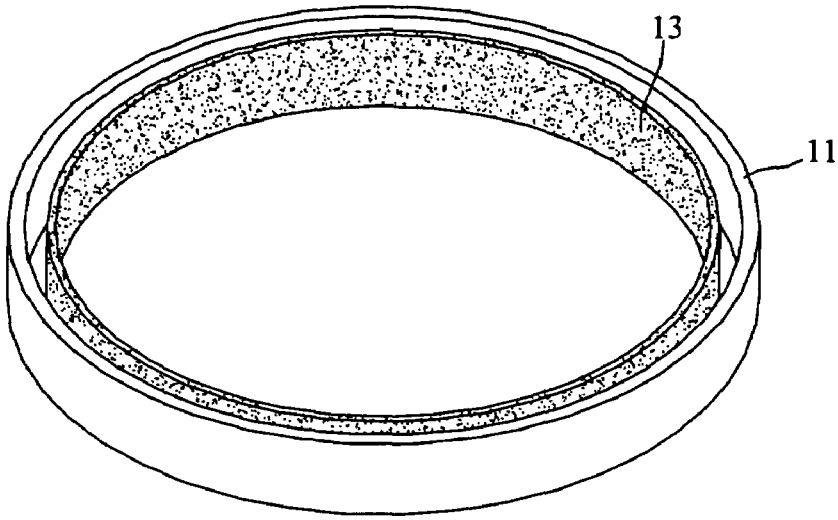
FIG. 3 is a preferred embodiment of a radial acoustic driver of the invention.

Please refer to FIG. 3. A ring type acoustic driver of the invention includes a cyclic resonance tube 11 filling of working fluid. A ring type electricity-acoustic energy transducer 13, inside the resonance tube, produces a radial acoustic wave in the working fluid.

The ring type electricity-acoustic energy transducer 13 is composed of electricity-acoustic energy transducing material. As it is driven by electric power with designed frequency, a radial acoustic wave with high pressure fluctuation can be produced by combining normal vibration and a bending effect.

The electricity-acoustic energy transduced material can be a piezoelectricity material.

Figure 4:
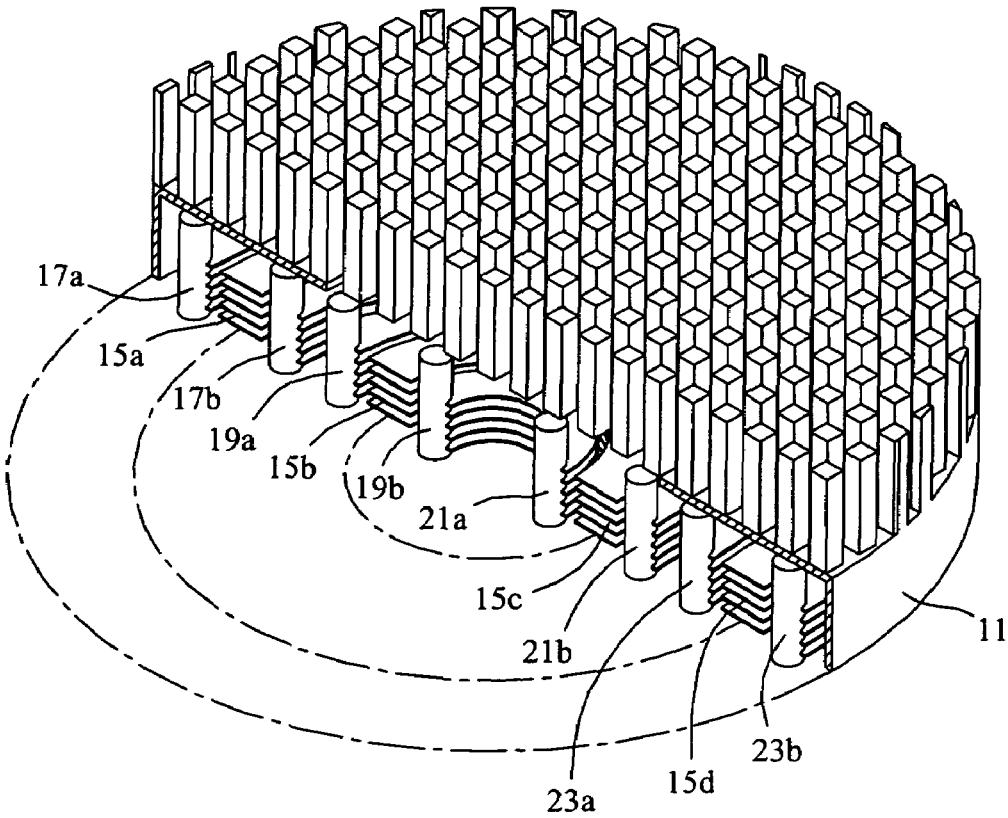
FIG. 4 is a preferred embodiment of a radial acoustic driver of the invention which is applied to a thermoacoustic device.

Please refer to FIG. 4. A thermoacoustic device of the invention, which uses a ring type acoustic driver generated radial acoustic wave, includes a working fluid in the resonance tube 11, to provide a standing wave in the working fluid. At least one set of stacks 15*a*, 15*b*, 15*c*, and 15*d* can be mounted in the resonance tube 11. Each of the stacks 15*a*, 15*b*, 15*c*, and 15*d* is composed of a plurality of plates. Preferably, at least one supporting element is formed in the space between the plates of stacks 15*a*, 15*b*, 15*c*, and 15*d* to provide a passage for the working fluid. The stacks 15*a*, 15*b*, 15*c*, and 15*d* can also be mounted directly on the round surface of the resonance tube 11.

The plate can be a low thermal conductive plate.

The heat exchangers 17*a*, 17*b*, 19*a*, 19*b*, 21*a*, 21*b*, 23*a*, and 23*b* are individually mounted on both sides of each stack 15*a*, 15*b*, 15*c*, and 15*d*. In other words, the stacks 15*a*, 15*b*, 15*c*, and 15*d* are interlaced with the heat exchangers 17*a*, 17*b*, 19*a*, 19*b*, 21*a*, 21*b*, 23*a*, and 23*b*. Each heat exchanger 17*a*, 17*b*, 19*a*, 19*b*, 21*a*, 21*b*, 23*a*, and 23*b* is composed of a plurality of fins mounted in parallel on the tube for providing heat exchange. The heat exchanging tube is preferably a straight or bended tube. The heat exchangers can be connected to a plurality of heat conductive pipes.

Figure 5:
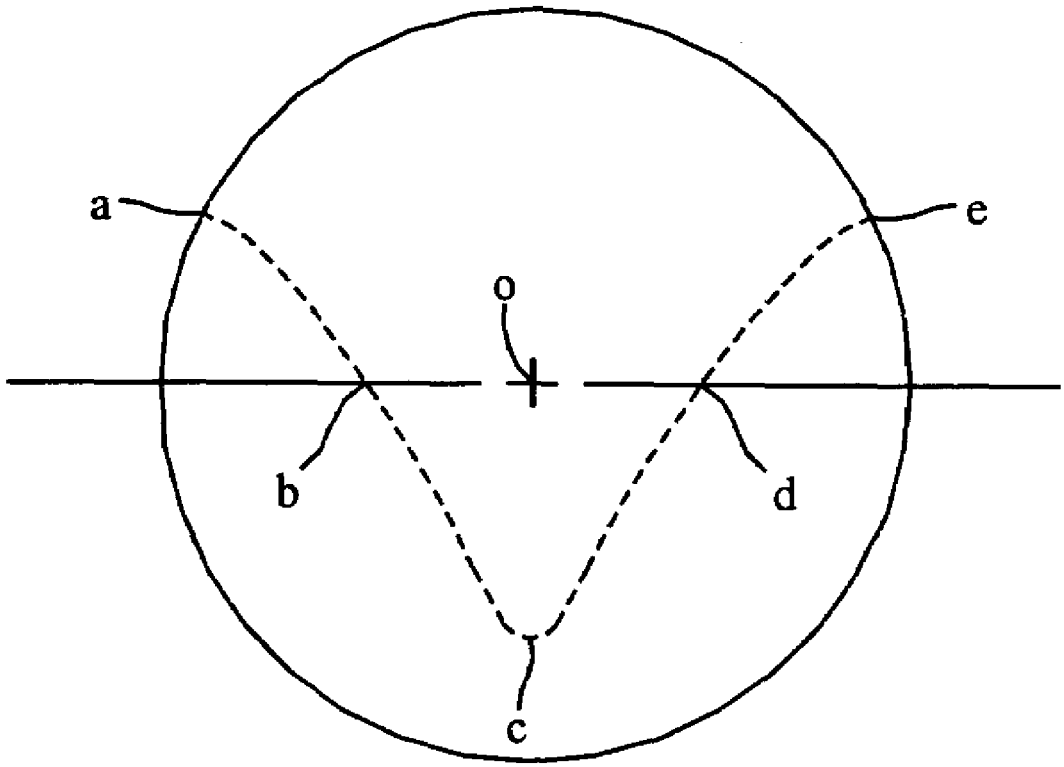
FIG. 5 is an explanatory figure showing a possible wave pattern of the standing wave in the resonance tube.

Please refer to FIG. 5, which shows a possible wave pattern for the standing wave in the resonance tube. The highest wave amplitude is located near the center of the resonance tube.

In FIGS. 4 and 5, at lease one stack 15*a*, 15*b*, 15*c*, and 15*d* can be mounted between the nodes b and d and the anti-nodes a,c and e in the resonance tube 11. The heat exchangers 17*a*, 17*b*, 19*a*, 19*b*, 21*a*, 21*b*, 23*a*, and 23*b*, which are located on both sides of each stack, are placed on the nodes b and d and anti-nodes a, c and e. In this embodiment, since there are three anti-nodes a,c and e and two nodes b and d, there can be four sets of stacks.

The following describes the operation of the thermoacoustic device of the invention that uses a ring type acoustic driver.

When an electric power with designed frequency is activated, the resonance tube 11 and the electricity-acoustic energy transducer generate a pressure fluctuation to form a standing wave in the resonance tube to oscillate the working fluid. According to the distribution of pressure fluctuation, the working fluid is compressed and expanded cyclically, and the temperature varies with the change. When the working fluid moves along the stacks 15*a*, 15*b*, 15*c*, and 15*d*, the temperature raises due to the compression. Then, the working fluid moves toward the other end of the stacks 15*a*, 15*b*, 15*c*, and 15*d*, expands and lowers its temperature. Therefore, it absorbs thermal energy at the other end of the stacks 15*a*, 15*b*, 15*c*, and 15*d*. Since there is thermal transfer retardation between the working fluid and the rigid boundary of the stacks 15*a*, 15*b*, 15*c*, and 15*d*, temperature gradients of the working fluid exist between the ends of the stacks 15*a*, 15*b*, 15*c*, and 15*d*, so thermal energy flows from one end of the stacks 15*a*, 15*b*, 15*c*, and 15*d* to the other. The thermal energy is transferred through the heat exchange tube of the other side of the heat exchangers 17*a*, 17*b*, 19*a*, 19*b*, 21*a*, 21*b*, 23*a*, and 23*b*, thus providing a cooling effect to heat sources. Since the pressure fluctuation effect is inversely proportional to the measure of area, the effect is increased when the measure of the surface is smaller. This causes a concentration effect at the center of the disc, so higher pressure fluctuation can be obtained at the center of the disc even if the input energy is the same. Thus the stacks that are closer to the center can create a lower temperature.

Further, the multiple stacks and heat exchangers provide multi-stage heat transference that is much more efficient than a conventional single-stage device when being activated by the same driver.

In summary, using the invention not only solves the problem of low acoustic pressure in the prior art, but also increases the cooling capacity of the thermoacoustic device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A radial acoustic driver comprising:

a cyclic type resonance tube which is filled with a working fluid inside; and a ring type electricity-acoustic energy transducer, inside the cyclic type resonance tube for generating a radial wave to the working fluid when receiving electricity.

2. The radial acoustic driver of claim 1, wherein said ring type electricity-acoustic energy transducer includes a layer of piezoelectricity material.

3. A thermoacoustic device using a radial acoustic driver comprising:

a cyclic type resonance tube which is filled a working fluid inside;

a ring type electricity-acoustic energy transducer for generating a radial standing wave along the cyclic type resonance tube when receiving electricity;

a plurality of cyclic stacks, distributed in the space of the ring type resonance tube and made of a plurality of plates which have at least one supporting element to support the structure of the stack, forming a passage for passing through the working fluid; and a plurality of heat exchangers, mounted at both sides of the stack for heat exchange with outside.

4. The thermoacoustic device of claim 3, wherein said working fluid moves through the stack when exited by the radial acoustic wave.

5. The thermoacoustic device of claim 3, wherein said heat exchangers are mounted on at least one node and at least one anti-node of the radial wave.

6. The thermoacoustic device of claim 3, wherein said stack has a center located between a node and an anti-node of the radial acoustic wave.

7. The thermoacoustic device of claim 3, wherein said ring type electricity-acoustic energy transducer includes a layer of piezoelectricity material.

8. The thermoacoustic device of claim 3, wherein said stack is composed of a plurality of plates which are low thermal conductivity plates.

9. The thermoacoustic device of claim 3, wherein said heat exchanger is composed of a plurality of fins which are plates.

10. The thermoacoustic device of claim 3, wherein said stacks which are adjacent to each other use the same heat exchanger.

11. The radial acoustic driver of claim 1, wherein the amplitude of pressure fluctuation is enhanced at the center of the cyclic type resonance tube.

12. The radial acoustic driver of claim 1, wherein the ring type electricity-acoustic energy transducer generates a radial wave to the working fluid directly.

13. The radial acoustic driver of claim 3, wherein the amplitude of pressure fluctuation is enhanced at the center of the cyclic type resonance tube.

14. The radial acoustic driver of cLaim 3, wherein the ring type electricity-acoustic energy transducer generates a radial wave to the working fluid directly.

* * * * *